US011498754B2

(12) United States Patent
Zhang et al.

(10) Patent No.: US 11,498,754 B2
(45) Date of Patent: Nov. 15, 2022

(54) CONTAINER FLOOR ASSEMBLY

(71) Applicant: BEIJING HANDLER MULTIMODAL TRANSPORT CO., LTD., Beijing (CN)

(72) Inventors: Lizhou Zhang, Beijing (CN); Shiwei Hu, Beijing (CN)

(73) Assignee: BEIJING HANDLER MULTIMODAL TRANSPORT CO., LTD., Beijing (CN)

( * ) Notice: Subject to any disclaimer, the term of this patent is extended or adjusted under 35 U.S.C. 154(b) by 367 days.

(21) Appl. No.: 16/636,642

(22) PCT Filed: Aug. 29, 2018

(86) PCT No.: PCT/CN2018/102981
§ 371 (c)(1),
(2) Date: Feb. 5, 2020

(87) PCT Pub. No.: WO2019/047755
PCT Pub. Date: Mar. 14, 2019

(65) Prior Publication Data

US 2021/0147142 A1 May 20, 2021

(30) Foreign Application Priority Data

Sep. 8, 2017 (CN) ..... 201710805347.7

(51) Int. Cl.
*B60P 7/08* (2006.01)
*B65D 90/00* (2006.01)

(52) U.S. Cl.
CPC ..... *B65D 90/006* (2013.01)

(58) Field of Classification Search
CPC ..... B60P 3/077; B60P 7/08; B60P 7/0892; B60P 7/13; B60P 7/135; B60P 1/14
(Continued)

(56) References Cited

U.S. PATENT DOCUMENTS 4,695,211 A * 9/1987 Van Iperen ..... B60P 7/135 410/94
4,941,784 A * 7/1990 Flament ..... B60R 7/02 410/121

(Continued)

FOREIGN PATENT DOCUMENTS

CA 2535104 A1 8/2007
CN 2496815 Y 6/2002

(Continued)

*Primary Examiner* — Stephen T Gordon
(74) *Attorney, Agent, or Firm* — Bayramoglu Law Offices LLC

(57) ABSTRACT

A container floor assembly includes a floor unit, a blocking member and a limiting member, wherein the blocking member is supported on the floor unit, and the limiting member detachably connects the floor unit and the blocking member in a manner of restricting a relative lateral movement of the blocking member and the floor unit. Each of the blocking member and the floor unit is provided with a limiting structure, the limiting member is detachable and connected to the limiting structures in the blocking member and the floor unit simultaneously. The floor unit includes a floor body and a floor chassis, the floor body is mounted on the floor chassis, and the blocking member is supported on the floor body.

15 Claims, 2 Drawing Sheets

(58) Field of Classification Search
USPC ..... 410/30, 49, 90, 91, 94, 95, 121, 153
See application file for complete search history.

(56) References Cited

U.S. PATENT DOCUMENTS

| | | | | |
|---|---|---|---|---|
| 5,193,700 | A | 3/1993 | Lyman et al. | |
| 5,476,348 | A * | 12/1995 | Shelleby | B60P 7/12 410/49 |
| 5,549,428 | A * | 8/1996 | Yeatts | B60P 7/0892 410/121 |
| 5,836,605 | A | 11/1998 | Bowling | |
| 2006/0099046 | A1* | 5/2006 | Dockery | B60P 7/14 410/121 |
| 2015/0151665 | A1 | 6/2015 | Taylor et al. | |

FOREIGN PATENT DOCUMENTS

| | | | |
|---|---|---|---|
| CN | 2635601 | Y | 8/2004 |
| CN | 2637394 | Y | 9/2004 |
| CN | 201183656 | Y | 1/2009 |
| CN | 204452182 | U | 7/2015 |
| CN | 107758156 | A | 3/2018 |
| CN | 207390094 | U | 5/2018 |

* cited by examiner

CONTAINER FLOOR ASSEMBLY

CROSS REFERENCE TO THE RELATED APPLICATIONS

This application is the national phase entry of International Application No. PCT/CN2018/102981, filed on Aug. 29, 2018, which is based upon and claims priority to Chinese Patent Application No. 201710805347.7, filed on Sep. 8, 2017, the entire contents of which are incorporated herein by reference.

TECHNICAL FIELD

The present disclosure belongs to the technical field of containers, and in particular relates to a container floor assembly.

BACKGROUND

At present, there are three ways to prevent cargoes from falling over or colliding with the inner wall of a container. The first way is to place shelves for different cargoes in the container to restrict the movement of the cargoes. The second way is to arrange a buffering beam on the inner wall of the container to prevent damage to cargoes caused by cargoes directly hitting the inner wall of the container. The third way is to place cargoes directly on the container floor, and to fill a foamed material between the respective cargoes and between cargoes and the inner wall of the container. For the above three limiting structures (i.e. a shelf, a buffering beam and a foamed material), the first limiting structure must use different shelves according to different cargoes. Different shelves cause inconvenience, poor stability, and a high cost during loading and unloading of the shelves in the container. The second limiting structure can be applied to a variety of cargoes, but is only applied to limit cargoes adjacent to each other, rather than the cargoes not adjacent to each other. As for the third limiting structure, the foaming material cannot be reused, resulting an increase in transportation cost. Moreover, the foaming material mainly prevents collisions between the cargoes and between the container and the cargoes, but does not restrict the movement of the cargoes in the container. In fact, it is the inner wall of the container that restricts the movement of the cargoes when the foaming material is used.

In summary, the limiting structure capable of restricting the movement of cargoes in the prior art cannot be applied to a variety of different cargoes, or can only restrict the movement of cargoes at positions adjacent to the inner wall of the container.

SUMMARY

(i) Technical Problem to be Solved

In order to solve the deficiencies of the inability to be applied to a variety of cargoes and only being able to restrict movement of cargoes adjacent to the inner wall in the prior art, the present disclosure provides a container floor assembly having a limiting function for the cargoes. The container floor assembly can be applied to a variety of cargoes and can restrict the movement of cargoes located inside the container.

(ii) Technical Solution

In order to achieve the above objective, the main technical solutions adopted by the present disclosure include:

The present disclosure provides a container floor assembly including a floor unit, a blocking member and a limiting member, wherein the blocking member is supported on the floor unit, and the limiting member is detachable and connects the blocking member and the floor unit together in a manner of restricting a relative lateral movement of the blocking member and the floor unit.

According to the present disclosure, each of the blocking member and the floor unit is provided with a limiting structure, the limiting member is detachable and connected to the limiting structures in the blocking member and the floor unit simultaneously; or the limiting member is fixedly connected to the blocking member, the floor unit is provided with a limiting structure, and the limiting member is detachable and connected to the limiting structure of the floor unit.

According to the present disclosure, the limiting member is a limiting pin, the limiting structure of each of the floor unit and the blocking member is a limiting hole, and the limiting pin is simultaneously inserted into the limiting holes of the blocking member and the floor unit in a pluggable manner; or the limiting member is an insertion pole, the top end of the insertion pole is connected to the blocking member, the limiting structure of the floor unit is a limiting hole, and the insertion pole is inserted into the limiting hole of the floor unit in a pluggable manner.

According to the present disclosure, the floor unit includes a floor body and a floor chassis, the floor body is mounted on the floor chassis, and the blocking member is supported on the floor body; wherein the floor body is provided with a first insertion hole, the floor chassis is provided with a second insertion hole, the first insertion hole and the second insertion hole are coaxial, the second insertion hole constitutes a limiting hole of the floor unit, or the first insertion hole and the second insertion hole are combined to form the limiting hole of the floor unit, the limiting member is detachable and provided through the first insertion hole and the second insertion hole, and the limiting hole of the floor unit constitutes a limiting structure which forms a lateral limit to the limiting member.

According to the present disclosure, the floor chassis includes a plurality of spaced bottom beams and at least one connection member, wherein the connection member is connected between the two adjacent bottom beams, a protrusion member protrudes from the connection member toward the floor body, the second insertion hole is provided in the protrusion member, and a bottom end of the limiting member abuts against a hole bottom of the second insertion hole.

According to the present disclosure, the bottom surface of the connection member is flush with the bottom surface of the bottom beam.

According to the present disclosure, the top end of the protrusion member abuts against the floor body.

According to the present disclosure, the protrusion member is a cylinder, or the protrusion member is composed of a plurality of cambered plates that are spaced and formed into a ring shape; a reinforcement rib is fixed between an outer wall of the protrusion member and the connection member.

According to the present disclosure, the blocking member includes a blocking portion and a connection portion, the blocking portion is angularly connected to the connection portion, the connection portion is supported on the floor unit, and the limiting member forms a lateral limit to the connection portion.

According to the present disclosure, both the blocking portion and the connection portion are plates which are at a right angle, and a reinforcement rib plate is fixed between the blocking portion and the connection portion.

According to the present disclosure, a material of the blocking member is polyurethane rigid foam, fiber reinforced composite material or steel; and/or a material of the limiting member is polyurethane rigid foam, fiber reinforced composite material or steel.

(iii) Advantage

The advantages of the present disclosure are as follows:

In the present disclosure, a blocking member and a floor unit are detachable and connected by a limiting member. When the blocking member and the floor unit are connected, the limiting member restricts the relative lateral movement of the blocking member and the floor unit, thereby transmitting a lateral acting force during the cargo transportation process to the floor unit and restricting the movement of the cargoes in the container. The structure can be used for cargoes inside the container regardless of their positioning in the container (i.e. not adjacent to the inner wall). Additionally, the structure can be used repeatedly and applied to different cargoes, which saves costs by eliminating the need of customized shelves.

REFERENCE SIGNS

1: floor unit; 11: floor body; 111: first insertion hole; 12: floor chassis; 13: lower limiting structure; 121: second insertion hole; 122: bottom beam; 123: connection member; 124: protrusion member; 125: reinforcement rib; 2: blocking member; 21: blocking portion; 22: connection portion; 23: reinforcement rib plate; 24: upper limiting structure; 3: limiting member; 4: cargo.

DETAILED DESCRIPTION OF THE EMBODIMENTS

For a better explanation of the present disclosure to facilitate the understanding, the present disclosure will be described in detail hereafter with reference to the drawings and the specific embodiments.

Embodiment 1

Figure 1:
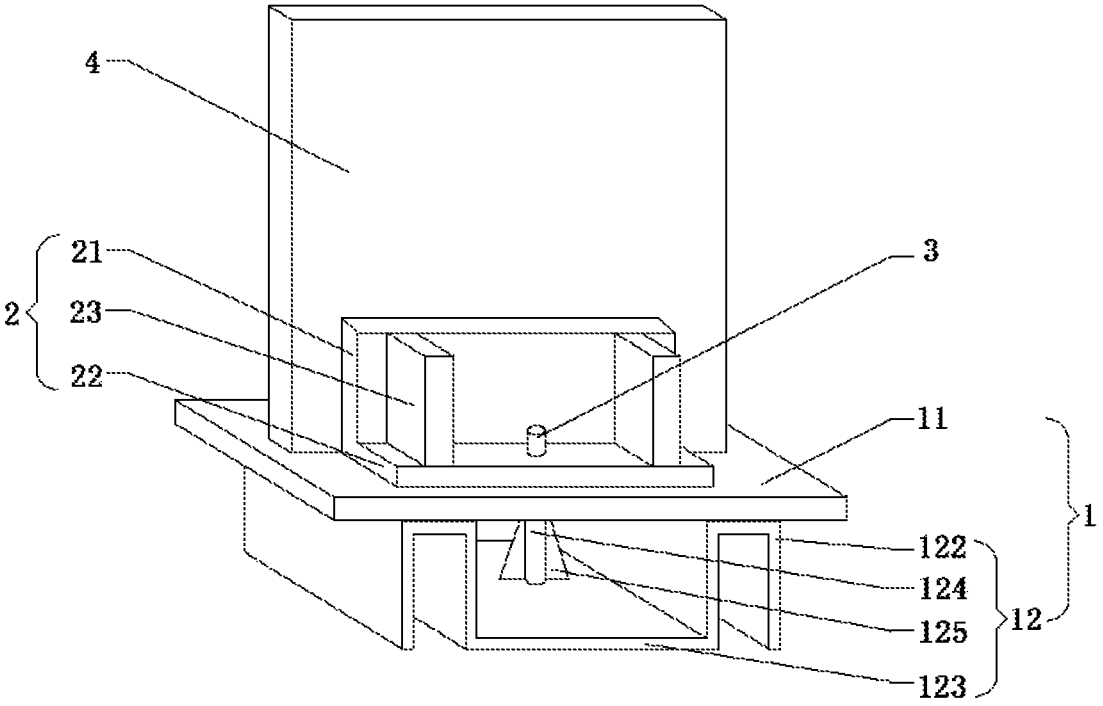
FIG. 1 is a schematic perspective view of a container floor assembly provided in Embodiment 1, wherein a cargo is shown.
Figure 2:
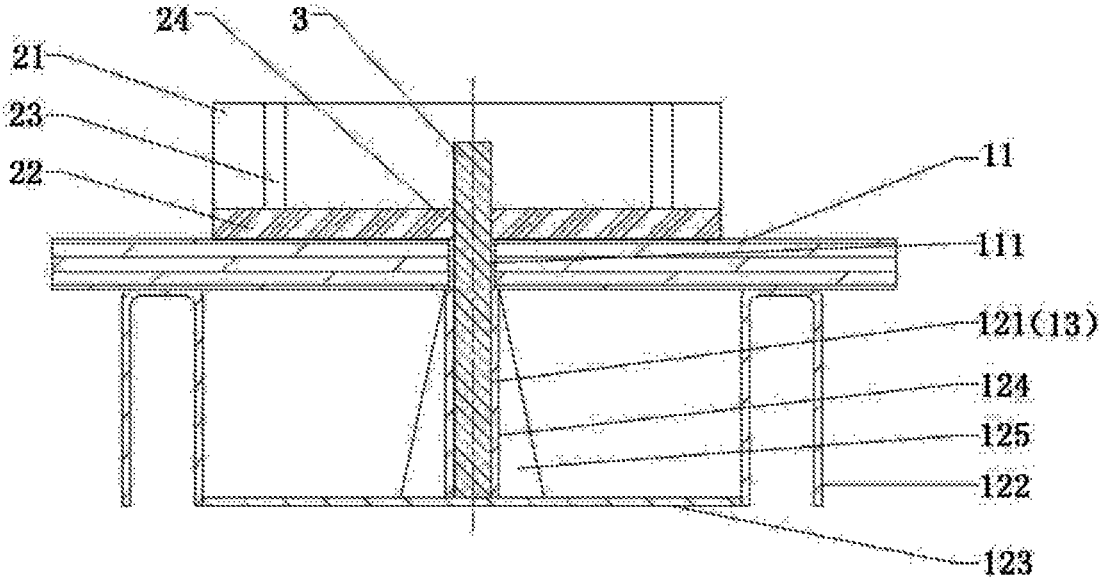
FIG. 2 is a schematic cross-sectional view of the container floor assembly in FIG. 1.

As shown in FIGS. 1 and 2, a container floor assembly is provided in this embodiment. The container floor assembly includes the floor unit 1, the blocking member 2 and the limiting member 3. The blocking member 2 is supported on the floor unit 1. The limiting member 3 detachably connects the blocking member 2 and the floor unit 1 together in a manner of restricting a relative lateral movement of the blocking member 2 and the floor unit 1, namely, the blocking member 2 and the floor unit 1 are detachable and connected together by the limiting member 3, and when the limiting member 3 connects the blocking member 2 and the floor unit 1, the limiting member 3 restricts the relative lateral movement of the blocking member 2 and the floor unit 1. Herein, the term "lateral" means that the limiting member 3 restricts the movement of the blocking member 2 relative to the floor unit 1 in any one direction of the front, rear, left and right directions or in a direction of a vector of multiple directions, and whether the limiting member 3 restricts the blocking member 2 from approaching to and moving away from the floor unit 1 is included in the protection scope of the present disclosure.

Consequently, a lateral acting force on the cargo 4 during the cargo transportation process is transmitted to the floor unit 1 by the blocking member 2 and the limiting member 3, restricting the movement of the cargo 4 in the container. On the one hand, compared to the prior art in which an anti-collision beam is disposed, the structure can be used for the cargo 4 inside the container, but is not limited to only the cargo 4 adjacent to the inner wall of the container; on the other hand, compared to the prior art in which a shelf is disposed, the structure can be used repeatedly and applied to different cargoes 4, which eliminates the need for customizing shelves and saves the cost.

Specifically, in the present embodiment, the blocking member 2 includes the blocking portion 21 and the connection portion 22, and the blocking portion 21 is angularly connected to the connection portion 22, that is, a bent structure is formed there between. The connection portion 22 is supported on the floor unit 1. The limiting member 3 is connected to the connection portion 22 to form a lateral limit of the connection portion 22. The limiting member 3 limits the connection portion 22, thereby limiting the entire blocking member 2. The blocking portion 21 is used to block the movement of the cargo 4.

Preferably, the blocking member 2 includes a support surface for supporting blocking member 2 on the floor unit 1, that is, the floor unit 1 is in surface-to-surface contact with the blocking member 2 to improve the stability of support. In the present embodiment, the connection portion 22 includes the above-mentioned support surface.

Preferably, the blocking member 2 includes a blocking surface configured for the cargo 4 to abut and form surface-to-surface contact with the cargo 4, that is, the shape of the blocking surface is matched with the shape of the abutting surface of the cargo 4. For example, if the abutting surface of the cargo 4 is a flat surface, the blocking surface is also a flat surface, and if the abutment surface of the cargo 4 is a cambered surface, the blocking surface is also a cambered surface. In the present embodiment, the blocking portion 21 includes a blocking surface configured for the cargo 4 to abut and form surface-to-surface contact with the cargo 4. The cargo 4 is blocked by the blocking surface, thereby properly stabilizing the cargo 4 and preventing the cargo 4 from damage. Preferably, the blocking portion 21 has a multi-layer structure (for example, including a support layer and a soft pad), and the outermost layer is a soft pad (e.g., a foamed foam pad, a rubber pad, and others). The outer surface of the soft pad constitutes the above-mentioned blocking surface. The soft pad both is configured to provide a buffering power, and protect the cargo 4. Of course, the present disclosure is not limited thereto. In other embodiments, the blocking member 2 may also have a shape without a bending structure such as a cube or a cuboid, which can also have a limiting function, but the structure of the present embodiment is more material-saving.

Further, in the present embodiment, the blocking member 2 includes one blocking portion 21 and one connection portion 22. Both the blocking portion 21 and the connection portion 22 are plates, which are at a right angle, so that the blocking member 2 is generally L-shaped, and the outer surface of one side of the blocking portion 21 away from the connection portion 22 constitutes a blocking surface. Of course, the present disclosure is not limited thereto. In other embodiments, the blocking member 2 may include two blocking portions 21 and one connection portion 22. The two blocking portions 21 are respectively connected to opposite sides of the connection portion 22 to form an inverted n shape. With such structure, the same blocking member 2 can block the cargoes 4 located on opposite sides thereof. Based on this, it is also understood that the blocking member 2 can also be provided with three or four blocking portions 21 for blocking the cargoes 4 located on three sides or four sides thereof. Therefore, preferably, the blocking member 2 of the present disclosure includes one connection portion 22 and one to four blocking portions 21. The blocking portions 21 are arranged in parallel or perpendicularly to one another. Further, the blocking surfaces of the blocking portions 21 are also arranged in parallel or perpendicularly to one another.

Preferably, a reinforcement member, i.e. the reinforcement rib plate 23, is fixed between the blocking portion 21 and the connection portion 22. In the present embodiment, two reinforcement ribs 23 are provided, and the reinforcement rib 23 has a rectangular plate shape. In this way, the weight of the blocking member 2 is reduced while ensuring that blocking member 2 has sufficient strength. Of course, the number of reinforcement ribs 23 is not limited to this embodiment, and one or more reinforcement ribs 23 may be used. Moreover, the shape of the reinforcement rib 23 is not limited to a rectangular plate, and may be other shapes such as a triangular plate.

Preferably, the height of the blocking surface (i.e., the height of the blocking portion 21 in the present embodiment) is 20-30 cm, the thickness of the blocking portion 21 is 3-5 cm, and the thickness of the connection portion 22 is 3-5 cm. Preferably, the blocking member 2 is an integrated member, i.e. an integratedly formed member, and the blocking member 2 is a steel member. Of course, the present disclosure is not limited thereto. In other embodiments, the material of the blocking member 2 may also be polyurethane rigid foam or fiber reinforced composite material, or may be other materials capable of providing the same level of rigidity or higher rigidity.

Further, in the present embodiment, each of the blocking member 2 and the floor unit 1 is provided with a limiting structure. In the present embodiment, the limiting structure of the blocking member 2 is provided on the connection portion 22 of the blocking member 2. As shown in FIGS. 1 and 2, the limiting structure of the blocking member 2 is the upper limiting structure 24, and the limiting structure of the floor unit 1 is the lower limiting structure 13. The lower limiting structure 13 restricts the lateral movement of the limiting member 3, and the limiting member 3 restricts the lateral movement of the upper limiting structure 24, so that the floor unit 1 restricts the lateral movement of the blocking member 2 by the limiting member 3.

Specifically, the limiting member 3 is detachable and connected to the limiting structures in the blocking member 2 and the floor unit 1 simultaneously. It can be understood that both the limiting structures of the blocking member 2 and the limiting structure of the floor unit 1 are prefabricated, but not formed during the process of connecting the blocking member 2 to the floor unit 1 by the limiting member 3. Moreover, the shapes of the limiting structures of the blocking member 2 and the floor unit 1 are matched with the limiting member 3, which has a function that the limiting member 3 at least restricts the lateral movement of the blocking member 2 relative to the floor unit 1 and is detachable.

Preferably, the floor unit 1 is provided with a plurality of limiting structures, and one or more of the blocking members 2 are selectively and correspondingly connected to any one or more of the plurality of limiting structures of the floor unit 1 by one or more of the limiting members 3, namely, the limiting member 3 can connect the limiting structure of the blocking member 2 to a suitable limiting structure of the plurality of limiting structures in the floor unit 1 according to the placement position of the cargo 4, thereby mounting the blocking member 2 at a suitable position in course of the current transportation. As for one cargo 4 or a group of cargoes 4, depending on the position thereof, the blocking member 2 is provided in a direction in which it is required to restrict the movement of the cargo 4. For example, if the cargo 4 is not adjacent to the inner wall of the container or the cargo 4 is not intended to abut against the inner wall of the container, the blocking member 2 can be provided around the cargo 4. Preferably, the plurality of limiting structures on the floor unit 1 are arrayed in a matrix manner. In addition, in the present embodiment, the blocking member 2 is provided with one limiting structure, but it is not limited thereto. The blocking member 2 may be provided with a plurality of limiting structures, as long as the arrangement of the limiting structures on the blocking member 2 match the arrangement of the limiting structures on the floor unit 1. Of course, the limiting member 3 also needs to match the limiting structure of the blocking member 2 and the limiting structure on the floor unit 1.

Specifically, in the present embodiment, the limiting member 3 is a cylindrical limiting pin, and the limiting structure of each of the floor unit 1 and the blocking member 2 is a limiting hole (the limiting hole is a cylindrical hole in this embodiment). In the present embodiment, the limiting hole on the blocking member 2 is located between the two reinforcement rib plates 23 therein. The limiting holes of the floor unit 1 and the blocking member 2 are coaxially provided, and the limiting pin is simultaneously inserted into the limiting holes of the blocking member 2 and the floor unit 1 in a pluggable manner. Thereby in the present embodiment, the lateral relative movement of the blocking member 2 and the floor unit 1 is restricted by the pluggable insertion of the limiting pin. Preferably, the limiting pin and the limiting hole of the floor unit 1 and that of the blocking member 2 both form transition fits or interference fits, more preferably transition fits, to prevent that the limiting pin cannot be easily pulled out due to an excessively tight fit therebetween. Moreover, in order to facilitate inserting and pulling out the limiting pin, when the limiting pin connects the floor unit 1 and the blocking member 2, the top surface of the limiting pin protrudes from the limiting hole on the blocking member 2. Of course, in other embodiments, the limiting pin may be provided with other structures that facilitate pulling out the limiting pin.

Further, it can be understood that the limiting pin is used as the limiting member 3, and the limiting member 3 at this time does not restrict the movement of the blocking member 2 approaching to or moving away from the floor unit 1.

When the blocking portion 21 of the blocking member 2 is subjected to an impact force on the cargo 4, the blocking portion 21 transmits the force to the connection portion 22, and the connection portion 22 transmits the force to the limiting pin through the hole wall of the limiting hole thereon, and the limiting pin transmits the force to the hole wall of the limiting hole of the floor unit 1 and further transmits the force to the floor unit 1. In such a way, the floor unit 1 stabilizes the blocking member 2 by the limiting pin, and further stabilizes the cargo 4. The limiting pin is used as the limiting member 3, and the limiting structures of the floor unit 1 and the blocking member 2 is correspondingly configured as limiting holes, which facilitates the connection and disassembly of the blocking member 2 and the floor unit 1, improves the disassembly and mounting efficiency, and does not damage the floor unit 1.

Of course, in other embodiments of the present disclosure, the shapes of the limiting pin and the limiting hole are not limited to a cylindrical shape, and may be other shapes that can match to play a limiting function. The cylindrical limiting pin and the cylindrical limiting hole have the advantage of convenient mounting. Moreover, FIG. 1 shows that the blocking member 2 is provided with one limiting hole, so the blocking member 2 can be connected to the floor unit 1 by using one limiting pin. If the blocking member 2 is provided with a plurality of limiting holes, the blocking member 2 can be connected to the floor unit 1 by using a plurality of limiting pins.

Further, in the present embodiment, the floor unit 1 includes the floor chassis 12 and a plurality of floor bodies 11. The floor body 11 is mounted on the floor chassis 12, and the plurality of floor bodies 11 are spliced together to form a ground in the container. The blocking member 2 is supported on the floor body 11, that is, supported on the ground in the container. The floor body 11 may be detachable and mounted on the floor chassis 12 (for example, by bolts or screws), or may be affixed (for example, bonded or welded). Preferably, the floor chassis 12 is a steel structure that provides a stable support for the floor body 11 and is sufficient to bear the load of the cargo 4 in the container. The floor body 11 is a wooden member that is detachable and connected to the floor chassis 12 by screws.

Specifically, the floor body 11 is provided with a circular first insertion hole 111, the floor chassis 12 is provided with a circular second insertion hole 121, and the first insertion hole 111 and the second insertion hole 121 are coaxial. The second insertion hole 121 is a through hole, and the limiting pin pass through to the through hole and is connected to the floor chassis 12, wherein the fit between the limiting pin and the first insertion hole 111 on the floor body 11 is preferably a clearance fit, since the floor body 11 is a wooden member and the clearance fit between the limiting pin and the first insertion hole 111 can prevent the limiting pin from damaging the floor body 11. The second insertion hole 121 constitutes the above-mentioned limiting hole of the floor unit 1 and plays a limiting function on the limiting pin. Therefore, the fit between the limiting pin and the second insertion hole 121 on the floor chassis 12 is a transition or interference fit, the limiting pin is detachable and provided through the first insertion hole 111 and the second insertion hole 112, and the limiting hole of the floor unit 1 constitutes a limiting structure which forms a lateral limiting to the limiting pin. In summary, the limiting pin is tightly combined with the blocking member 2 and the floor chassis 12, and the impact force received by the blocking member 2 is transmitted to the floor chassis 12 via the limiting pin, so that the floor chassis 12 is subjected to the impact force, which is more stable compared to using the floor body 11. Of course, it is not limited to the embodiment. When the floor body 11 is not made of a wooden material or other materials with a poor impact resistance, the first insertion hole 111 can also form an interference or transition fit with the limiting pin (preferably a transition fit). At this time, the first insertion hole 111 and the second insertion hole 112 are combined to form the limiting hole of the floor unit 1, and play a limiting function on the limiting pin together.

Further, in the present embodiment, the floor chassis 12 includes a plurality of equally spaced bottom beams 122 and a plurality of connection members 123. The length direction of the bottom beam 122 is the width direction of the container, and the plurality of bottom beams 122 are spaced along the length direction of the container. The bottom beam 122 is n-shaped, and the top end plane thereof is connected to the floor body 11. Preferably, the bottom beam 122 is a steel member. The connection member 123 is connected between the two adjacent bottom beams 122 of a part of all the bottom beams, and the connection member 123 extends along the length direction of the bottom beam. A plurality of protrusion members 124 protrude from the connection member 123 toward the floor body 11. The plurality of protrusion members 124 are equally spaced along the length direction of the bottom beam 122. The protrusion member 124 may be integratedly formed with the connection member 123, or may be fixedly connected (for example, welded) to the connection member 123. In the present embodiment, the protrusion member 124 and the connection member 123 are an integratedly formed steel member. The connection member 123 and the bottom beam 122 may be an integrated member or may be fixedly connected together. In the present embodiment, the connection member 123 and the bottom beam 122 are welded together. Of course, the present disclosure is not limited thereto, and the connection member 123 may be provided between each two adjacent bottom beams 122.

Further, the second insertion hole 121 of the floor chassis 12 is provided in the protrusion member 124, and the bottom end of the limiting member 3 abuts against the hole bottom of the second insertion hole 121. In this embodiment, the second insertion hole 121 is a through hole penetrating the protrusion member 124, and therefore, the hole bottom of the second insertion hole 121 is formed by the upper surface of the connection member 123. However, the present disclosure is not limited thereto. In other embodiments, the second insertion hole 121 provided in the protrusion member 124 may be a blind hole, and the hole bottom of the second insertion hole 121 may be formed by the protrusion member 124 itself. Moreover, in other embodiments, the second insertion hole 121 may also be a through hole penetrating the protrusion member 124 and the connection member 123. The connection member 123 and the protrusion member 124 are configured to provide better support for the limiting pin (i.e., the limiting member 3), improve the stability of the blocking member 2, and improve the blocking capability of the blocking member 2.

Further, in the present embodiment, the connection member 123 is a connecting plate, and the bottom surface of the connection member 123 is flush with the bottom surface of the bottom beam 122 to be supported in the container together with the bottom beam 122, so that the limiting pin (i.e., the limiting member 3) is limited more stably. Moreover, the top end of the protrusion member 124 abuts against the floor body 11, that is, the floor body 11 is simultaneously supported on the bottom beam 122 and the protrusion member 124. At this time, the first insertion hole 111 is adjacent to the second insertion hole 112. Therefore, the contact area of the second insertion hole 121 and the limiting pin is larger, which can provide better support for the limiting pin (i.e., the limiting member 3), improve the stability of the blocking member 2, and improve the blocking capability of the blocking member 2.

Specifically, in the present embodiment, the protrusion member 124 is a cylinder, and a reinforcement member, preferably the reinforcement rib 125, is fixed between the outer wall of the protrusion member 124 and the connection member 123. The reinforcement rib 125 is welded to the protrusion member 124 and the connection member 123. Of course, the present disclosure is not limited thereto, and in other embodiments, the protrusion member 124 is composed of a plurality of cambered plates that are spaced and form into a ring shape. Moreover, the present disclosure is not limited thereto. In other embodiments, the outer shape of the protrusion member 124 is not limited to a circular shape, and may be any shape as long as the protrusion member 124 is provided with the insertion hole for inserting the limiting pin.

Preferably, the thickness of the floor body 11 is 28 mm, the height of the bottom beam 122 is 122 mm, the thickness of the connection member 123 is 4.5 mm, and the bottom beam 122 is 117.5 mm higher than the connection member 123.

In addition, in the present embodiment, the material of the limiting member 3 is polyurethane rigid foam, fiber reinforced composite material or steel, or may be other materials capable of providing the same level of rigidity or higher rigidity, so as to provide sufficient impact resistance.

The assembling process of the container floor assembly of this embodiment is as follows.

First, the bottom beam 122 is laid in the container, and the connection member 123 connected to the bottom beam 122 is also laid. And then, the floor body 11 is laid on and fixed to the bottom beam 122, wherein the first insertion hole 111 on the floor body 11 and the second insertion hole 121 in the protrusion member 124 on the connection member 123 must be coaxial. After that, according to the cargo 4 to be transported, the blocking member 2 is arranged at the corresponding position, the limiting hole on the blocking member 2 is aligned with the first insertion hole 111, and then the limiting pin sequentially passes through the limiting hole on the blocking member 2, the first insertion hole 111 and the second insertion hole 121, until the limiting pin touches the hole bottom of the second insertion hole 121. The cargo 4 can be placed in the container either before or after mounting the blocking member 2, which has particular advantages that the corresponding blocking member 2 can be disposed along with the loading of the cargo 4, thereby facilitating the loading of the cargo 4 and improving the overall loading efficiency.

In summary, the container floor assembly of the present embodiment is composed of assemblies, that is, the floor unit 1 is assembled with the blocking member 2, the floor chassis 12 is assembled with the floor body 11, and the floor chassis 12 itself is an assembly. The floor chassis 12 may include a separate bottom beam 122 and two bottom beams 122 connected together by the connection member 123. A plurality of separate bottom beams 122 and a plurality of two bottom beams 122 connected together by a connection member 123 are alternately arranged. A plurality of floor bodies 11 may be spliced together in any form. A plurality of first insertion holes 111 may be provided on one floor body 11, or only one first insertion hole 111 may be provided on one floor body 11, as long as the first insertion holes 111 on the ground formed by all the floor bodies 11 are aligned with the second insertion holes 121 on the floor chassis 12 one by one.

Of course, the structure of the floor unit 1 and the structure of the floor chassis 12 of the present disclosure are not limited to the above embodiment. The floor unit 1 can utilize any existing structure form, as long as it can be detachable and connected to the blocking member 2 and can be used to restrict the lateral movement of the blocking member 2.

Embodiment 2

Figure 3:
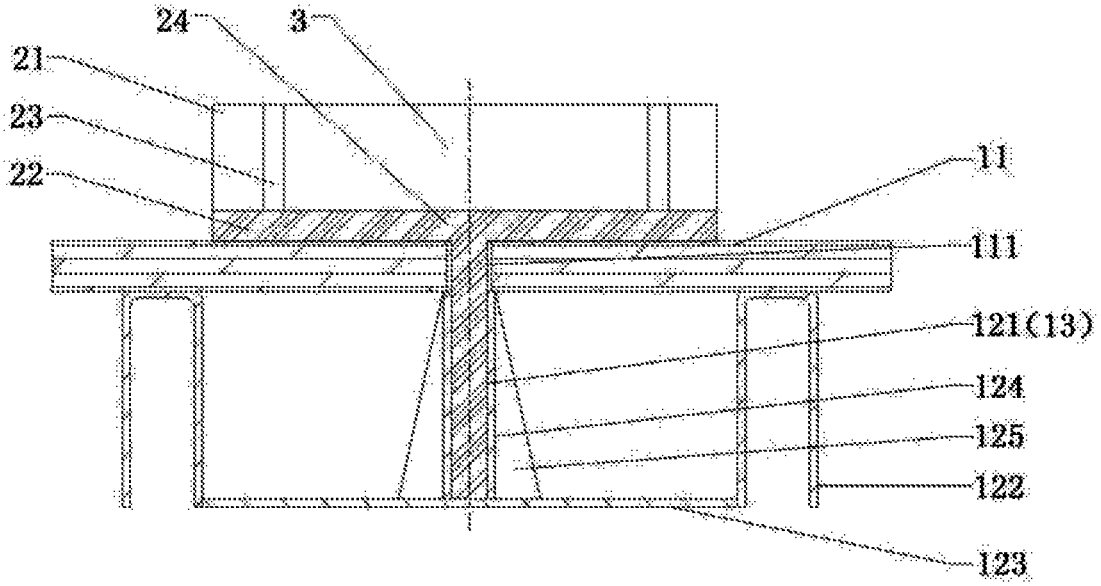
FIG. 3 is a schematic cross-sectional view of a container floor assembly provided in Embodiment 2.

With reference to FIG. 3, in the present embodiment, the difference from the first lies in that the limiting member 3 is fixedly connected to the blocking member 2, the floor unit 1 is provided with a limiting structure, and the limiting member 3 is detachable and connected to the limiting structure of the floor unit 1. Specifically, the limiting member 3 is an insertion pole, and the top end of the insertion pole is connected to the blocking member 2. The limiting structure of the floor unit 1 is a limiting hole, and the insertion pole is inserted into the limiting hole of the floor unit 1 in a pluggable manner. The insertion pole is located below the blocking member 2 or connected to the side of the blocking member 2. If the insertion pole is connected to the side of the blocking member 2, two insertion poles are preferably used, that is, two limiting members 3 are used. Correspondingly, when one blocking member 2 has two limiting members 3, two limiting structures on the floor unit 1 are connected to one blocking member 2. Preferably, the insertion pole is a cylinder. The insertion pole can be fixedly connected to the blocking member 2 by welding or the like, or the insertion pole and the blocking member 2 can be integratedly formed.

Embodiment 3

Figure 4:
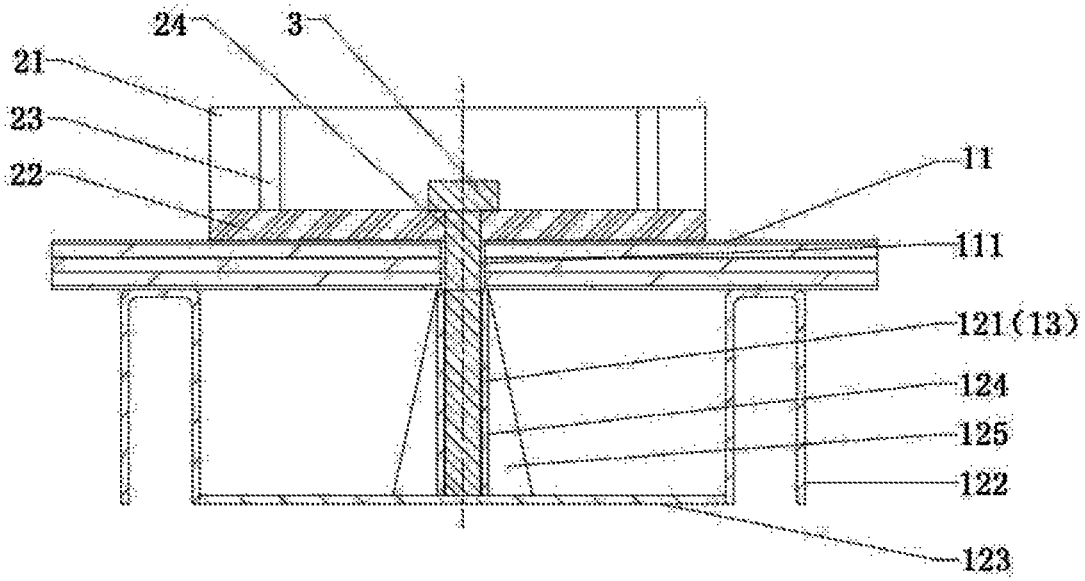
FIG. 4 is a schematic cross-sectional view of a container floor assembly provided in Embodiment 3.

With reference to FIG. 4, in the present embodiment, the difference from the embodiment 1 lies in that the limiting member 3 is a bolt, the limiting structure on the blocking member 2 is a through hole, the first insertion hole 111 in the floor body 11 is a through hole, the second insertion hole 121 on the floor chassis 12 is a threaded hole, and the bolt is screwed into the floor chassis 12. Thereby, the limiting member 3 not only restricts the lateral movement of the blocking member 2 relative to the floor unit 1, but also restricts the blocking member 2 from approaching to or moving away from the floor unit 1 (i.e., the vertical movement relative to the floor unit 1).

Compared with Embodiment 1, the bolt can further provide a function of restricting the vertical movement of the blocking member 2, but when comparing the bolt with the limiting pin, the bolt cannot be easily taken out if the threads of the bolt and the threaded hole are damaged by the impact force.

According to the embodiment 1 and the embodiment 3, the limiting member 3 of the present disclosure can restrict the blocking member 2 from approaching to or moving away from the floor unit 1 while restricting the lateral movement of the blocking member 2 relative to the floor unit 1, or can only restrict the lateral movement of the blocking member 2 relative to the floor unit 1.

The above contents are only preferred embodiments of the present disclosure, and for those skilled in the art, the specific embodiment and application scope can be changed according to the idea of the present disclosure. The contents of the present specification should not be construed as limitation to the present disclosure.

What is claimed is:

1. A container floor assembly, comprising a floor unit, a blocking member, and a limiting member, wherein the blocking member is supported on the floor unit, and the limiting member detachably connects the blocking member and the floor unit together in a manner of restricting a relative lateral movement of the blocking member and the floor unit, the floor unit comprises a floor body and a floor chassis, the floor body is mounted on the floor chassis, and the blocking member is supported on the floor body;

the floor body is provided with a first insertion hole, the floor chassis is provided with a second insertion hole, the first insertion hole and the second insertion hole are coaxial, the second insertion hole constitutes a first limiting hole of the floor unit, or the first insertion hole and the second insertion hole are combined to form the first limiting hole of the floor unit, the limiting member is detachable and provided through the first insertion hole and the second insertion hole, and the first limiting hole of the floor unit constitutes a first limiting structure in the floor unit, and the first limiting structure forms a lateral limiting to the limiting member, wherein the floor chassis comprises:

a plurality of spaced bottom beams; and at least one connection member, wherein the connection member is connected between two adjacent bottom beams of the plurality of spaced bottom beams, a protrusion member protrudes from the connection member toward the floor body, the second insertion hole is provided in the protrusion member, and a bottom end of the limiting member abuts against a hole bottom of the second insertion hole.

2. The container floor assembly according to claim 1, wherein the blocking member is provided with a second limiting structure, the limiting member is detachable and connected to the second limiting structure in the blocking member and the first limiting structure in the floor unit simultaneously; or the limiting member is fixedly connected to the blocking member, and the limiting member is detachable and connected to the first limiting structure of the floor unit.

3. The container floor assembly according to claim 2, wherein the limiting member is a limiting pin, the second limiting structure is a second limiting hole, and the limiting pin is simultaneously inserted into the first limiting hole and the second limiting hole in a pluggable manner; or the limiting member is an insertion pole, a top end of the insertion pole is connected to the blocking member, and the insertion pole is inserted into the first limiting hole of the floor unit in the pluggable manner.

4. The container floor assembly according to claim 1, wherein a bottom surface of the connection member is flush with a bottom surface of each of the plurality of spaced bottom beams.

5. The container floor assembly according to claim 1, wherein a top end of the protrusion member abuts against the floor body.

6. The container floor assembly according to claim 1, wherein the protrusion member is a cylinder, or the protrusion member is composed of a plurality of cambered plates, the plurality of cambered plates are spaced and formed into a ring shape;

a reinforcement rib is fixed between an outer wall of the protrusion member and the connection member.

7. The container floor assembly according to claim 1, wherein the blocking member includes a blocking portion and a connection portion, the blocking portion is angularly connected to the connection portion, the connection portion is supported on the floor unit, and the limiting member forms a lateral limit to the connection portion.

8. The container floor assembly according to claim 7, wherein both the blocking portion and the connection portion are plates at a right angle, and a reinforcement rib plate is fixed between the blocking portion and the connection portion.

9. The container floor assembly according to claim 1, wherein a material of the blocking member is polyurethane rigid foam, fiber reinforced composite material or steel; and a material of the limiting member is polyurethane rigid foam, fiber reinforced composite material or steel.

10. The container floor assembly according to claim 2, wherein a bottom surface of the connection member is flush with a bottom surface of each of the plurality of spaced bottom beams.

11. The container floor assembly according to claim 3, wherein a bottom surface of the connection member is flush with a bottom surface of each of the plurality of spaced bottom beams.

12. The container floor assembly according to claim 2, wherein a top end of the protrusion member abuts against the floor body.

13. The container floor assembly according to claim 3, wherein a top end of the protrusion member abuts against the floor body.

14. The container floor assembly according to claim 2, wherein the protrusion member is a cylinder, or the protrusion member is composed of a plurality of cambered plates, the plurality of cambered plates are spaced and formed into a ring shape;

a reinforcement rib is fixed between an outer wall of the protrusion member and the connection member.

15. The container floor assembly according to claim 3, wherein the protrusion member is a cylinder, or the protrusion member is composed of a plurality of cambered plates, the plurality of cambered plates are spaced and formed into a ring shape;

a reinforcement rib is fixed between an outer wall of the protrusion member and the connection member.

* * * * *